US009731189B2

(12) United States Patent
Greenmun

(10) Patent No.: US 9,731,189 B2
(45) Date of Patent: Aug. 15, 2017

(54) SYSTEM AND METHOD FOR A CARD GAME

(71) Applicant: Mahta Mahti Enterprises, LLC, Glendale, AZ (US)

(72) Inventor: Jeffrey G. Greenmun, Glendale, AZ (US)

( * ) Notice: Subject to any disclaimer, the term of this patent is extended or adjusted under 35 U.S.C. 154(b) by 179 days.

(21) Appl. No.: 14/696,291

(22) Filed: Apr. 24, 2015

(65) Prior Publication Data

US 2016/0023105 A1 Jan. 28, 2016

Related U.S. Application Data

(60) Provisional application No. 62/028,224, filed on Jul. 23, 2014.

(51) Int. Cl.

| | |
|---|---|
| ***A63F 1/00*** | (2006.01) |
| ***A63F 1/02*** | (2006.01) |
| ***A63F 1/04*** | (2006.01) |
| ***A63F 3/00*** | (2006.01) |

(52) U.S. Cl.

CPC ..... *A63F 1/00* (2013.01); *A63F 1/02* (2013.01); *A63F 2001/0416* (2013.01); *A63F 2003/00523* (2013.01); *A63F 2003/00861* (2013.01)

(58) Field of Classification Search

CPC ..... A63F 1/02; A63F 1/00

See application file for complete search history.

(56) References Cited

U.S. PATENT DOCUMENTS

| | | | |
|---|---|---|---|
| 3,680,866 | A | 8/1972 | Kerr |
| 4,146,235 | A | 3/1979 | Brautovich |
| 4,192,513 | A | 3/1980 | Feeley |
| 4,550,915 | A | 11/1985 | Meyer |
| 6,328,308 | B1 | 12/2001 | Kirby |
| 6,402,151 | B1 | 6/2002 | Forrester |
| 6,547,247 | B2 | 4/2003 | Hoyt |
| 6,971,649 | B2 | 12/2005 | Richardson et al. |
| 7,104,541 | B2 | 9/2006 | Green |

(Continued)

OTHER PUBLICATIONS

Game of square dominoes_20130409.pdf, "Mega game of dominoes," published on Apr. 9, 2013, available at https://web.archive.org/web/20130409032733/http://dominoopen.64g.ru/megaen.htm.*

*Primary Examiner* — William H McCulloch, Jr.

*Assistant Examiner* — Yingchuan Zhang

(74) *Attorney, Agent, or Firm* — Lisa Foundation Patent Law Clinic

(57) ABSTRACT

A card game comprising cards that contain indicia of a numerical digit from 0 through 9, or 'W' representing a wild function, printed and centered on all four-card edges. Some cards have duplicated digits in either opposing or adjacent positions. Other cards contain numerical or 'wild' sequences. Indicia are centered at the edges to card matching whereby the indicium may match and align with the indicia on other cards. Indicia calculate the play score based upon what does and does not match. All card corners contain a grouped visual representation of the four indicia on the edges so that a card's layout is legible regardless of its orientation when held in a fanned manner. Players complete the square 16-card playing area first and then continue to play atop the existing cards in separate board sections. This dynamic constantly changes the scoring landscape and requires a fluid strategy to manage.

20 Claims, 4 Drawing Sheets

(56) References Cited

U.S. PATENT DOCUMENTS

| | | | |
|---|---|---|---|
| 7,367,564 | B2 | 5/2008 | Latell |
| 7,631,873 | B2 | 12/2009 | Scriven |
| 8,721,414 | B1 | 5/2014 | Alhazza |

* cited by examiner

SYSTEM AND METHOD FOR A CARD GAME

CROSS REFERENCE TO RELATED APPLICATIONS

This application claims the benefit, under 35 U.S.C. §119(e) of U.S. Provisional Application No. 62/028224 filed Jul. 23, 2014 to Jeffrey G. Greenmun, entitled "System and Method for a Card Game", which is incorporated herein in its entirety.

BACKGROUND

1. Field of the Invention

The present invention is in the technical field of amusement devices and games.

More particularly, in the technical field of a card game and the method of playing. More particularly, in the field of a new card game utilizing a specialized playing card imprinted with numerical indicia and specifying a novel method and manner of play according to varied forms and rules.

2. Description of Related Art

Card games have been around for centuries and tend to favor the forms, indicia and biases of various cultures. Anglo-centric regions tend to favor playing cards that are rectangular in shape and utilize alphabetic and numeric indicia, and such formats have become the norm. Conventional playing cards are typically divided into four suits with each suit containing thirteen cards ranking from Ace to King for a total of 52 cards. Game play typically centers on ranking systems with game mechanics that value comparative rank, because these dynamics are so conducive to strategizing while maintaining degrees of chance based on card distribution. Numerous games of varying degrees of amusement and complexity have been structured around conventional playing cards and with a few exceptions they continue to dominate the family and competitive card game market. Nevertheless, novel and challenging new card games are always well received.

Unconventional card decks and games have made significant market contributions for decades. It is the intention of this present invention to serve that specialty card game market. To date, most novelty card games that utilize letters or numbers are elementary in nature and educational in purpose with simple play mechanics that are more social in nature than intellectually stimulating or competitive. Without discounting the evident educational applications, this present invention moves well beyond these utilitarian limitations with the object of offering an unconventional game form that is an intellectually stimulating game based in simple arithmetic strategy with sophisticated and competitive play mechanics.

So as to reduce the complexity and length of the Detailed Specification, and to fully establish the state of the art in certain areas of technology, Applicant herein expressly incorporate(s) by reference all of the following materials identified in each numbered paragraph below.

In U.S. Pat. No. 4,673,185, June 1987, Morley discloses a tile game in which the similarity to the present invention is limited to using a card matching style play and having the ability of the game device to match on multiple sides simultaneously.

In U.S. Pat. No. 5,037,110, August 1991, Haskel discloses a card game in which the similarity to the present invention is limited to being a square card playable in all four orientations, using a card matching style play and having the play mechanic of placing one card atop another.

In U.S. Pat. No. 5,524,898, June 1996, Pavlovic discloses a card game in which the similarity to the present invention is limited to being a square card playable in all four orientations, using a card matching style play and using a fixed play area profile.

In U.S. Pat. Application No. 2004/0070144A1, April 2004, Markus proposes a card device in which the similarity to the present invention is limited to being a square card playable in all four orientations, using a card matching style play and using a fixed play area profile.

In U.S. Pat. Application No. 2004/0188937A1, September 2004, Young proposes a card device in which the similarity to the present invention is limited to being a square card playable in all four orientations and using a card matching style play with optional numerical indicia.

However, none of these patents or applications disclose the essence of this invention, namely, a definitive card game comprised of a plurality of square playing cards bearing single digit numerical indicia from 0-9 on all four edges in various sequences capable of variable arithmetic strategizing while providing multiple play orientations in a fixed card-matching grid format which permits a player to consider multiple play options for each card per play to maximize scoring. Nor does any prior art reference either a strategic competitive inter-relationship between separate sections of a playing area or a play mechanic of placing cards atop one another in a way that constantly changes the scoring complexion of the playing surface.

Applicant believes that the material incorporated above is "non-essential" in accordance with 37 CFR 1.57, because it is referred to for purposes of indicating the background of the invention or illustrating the state of the art. However, if the Examiner believes that any of the above-incorporated material constitutes "essential material" within the meaning of 37 CFR 1.57(c)(1)-(3), Applicant will amend the specification to expressly recite the essential material that is incorporated by reference as allowed by the applicable rules.

BRIEF SUMMARY OF THE INVENTION

The present invention provides among other things a unique card game due to its overall design and play dynamics. The game is played with square cards each imprinted with unique sequences of single numerical digit 0-9 indicia where a single digit is imprinted at the center position of each of the four edges. The cards are played onto a 16-card square grid playing area referred to as the 'board'. The board is subdivided into two playing areas, the House field, comprised of the four center cards, and the Ring field, comprised of the twelve cards that surround the House field. In the preferred embodiment, the two fields are used by different players creating an extra element of competitive strategy.

The deck is shuffled and the cards are dealt out evenly in numbers based on game variation. Each player will maintain 6 cards in their hand and consistently replenish their own hand after each play by drawing from the personal reserve deck dealt to them in addition to the hand. The cards are played from the hand onto the board with the intention of matching the card's digits with those of cards to which it will adjoin in an edge-to-edge alignment so the player will consider multiple cards, card orientations and board placement options for scoring potential before playing. The scoring method is simple arithmetic where the number matches are summed and doubled; a value then from which the mismatches are summed and subtracted.

Players continue to play atop existing cards on the 16-card grid board according to the scoring opportunities of the potential matches-vs-mismatches with adjoining cards. This play dynamic changes the board's arithmetic scoring complexion turn for turn. Play continues until the reserve decks and then the cards-in-hand are played out to a finish where all have gone out on an equal number of plays for each player. The highest accumulated point score wins.

The prime object of this invention is to provide a new and novel card game that utilizes a familiar matching play method and simple arithmetic while employing play mechanics that drive several levels of complexity in strategic and competitive play variations so as to appeal to varied ages, skill levels and gaming interests.

Another object is to provide both families and educational institutions with an entertaining medium for strengthening critical thinking, arithmetic, variant analysis and pattern recognition skills for adults and kids alike.

Aspects and applications of the invention presented here are described below in the drawings and detailed description of the invention. Unless specifically noted, it is intended that the words and phrases in the specification and the claims be given their plain, ordinary, and accustomed meaning to those of ordinary skill in the applicable arts. The inventor is fully aware that he can be his own lexicographer if desired. The inventor expressly elects, as his own lexicographers, to use only the plain and ordinary meaning of terms in the specification and claims unless he clearly states otherwise and then further, expressly sets forth the "special" definition of that term and explains how it differs from the plain and ordinary meaning Absent such clear statements of intent to apply a "special" definition, it is the inventor's intent and desire that the simple, plain and ordinary meaning to the terms be applied to the interpretation of the specification and claims.

The inventor is also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventor is fully informed of the standards and application of the special provisions of pre-AIA 35 U.S.C. §112, ¶6 and post-AIA 35 U.S.C. §112(f). Thus, the use of the words "function," "means" or "step" in the Detailed Description or Description of the Drawings or claims is not intended to somehow indicate a desire to invoke the special provisions of pre -AIA 35 U.S.C. §112, ¶6 or post-AIA 35 U.S.C. §112(f), to define the invention. To the contrary, if the provisions of pre -AIA 35 U.S.C. §112, ¶6 or post-AIA 35 U.S.C. §112(f) are sought to be invoked to define the inventions, the claims will specifically and expressly state the exact phrases "means for" or "step for, and will also recite the word "function" (i.e., will state "means for performing the function of [insert function]"), without also reciting in such phrases any structure, material or act in support of the function. Thus, even when the claims recite a "means for performing the function of . . . " or "step for performing the function of . . . ," if the claims also recite any structure, material or acts in support of that means or step, or that perform the recited function, then it is the clear intention of the inventor not to invoke the provisions of pre -AIA 35 U.S.C. §112, ¶6 or post-AIA 35 U.S.C. §112(f). Moreover, even if the provisions of pre -AIA 35 U.S.C. §112, ¶6 or post-AIA 35 U.S.C. §112(f) are invoked to define the claimed inventions, it is intended that the inventions not be limited only to the specific structure, material or acts that are described in the preferred embodiments, but in addition, include any and all structures, materials or acts that perform the claimed function as described in alternative embodiments or forms of the invention, or that are well known present or later-developed, equivalent structures, material or acts for performing the claimed function.

The foregoing and other aspects, features, and advantages will be apparent to those artisans of ordinary skill in the art from the DETAILED DESCRIPTION and DRAWINGS, and from the CLAIMS.

BRIEF DESCRIPTION OF THE SEVERAL VIEWS OF THE DRAWINGS

A more complete understanding of the present invention may be derived by referring to the detailed description when considered in connection with the following illustrative figures. In the figures, like reference numbers refer to like elements or acts throughout the figures.

Figure 1:
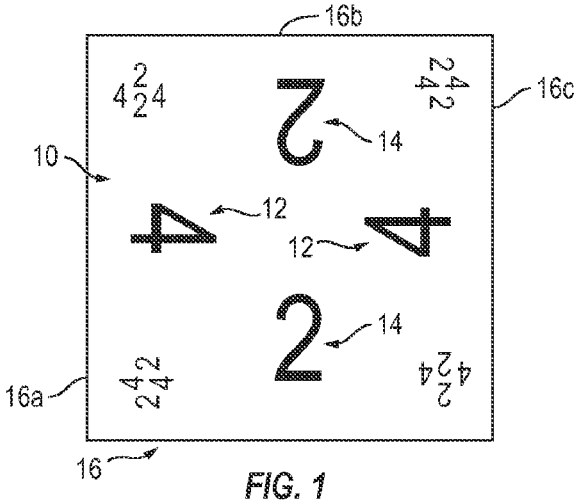
FIG. 1 depicts a top view of a representative card of a subset of the card deck of the present invention referred to as 'simple doubles'.

Elements and acts in the figures are illustrated for simplicity and have not necessarily been rendered according to any particular sequence or embodiment.

DETAILED DESCRIPTION OF THE INVENTION

In the following description, and for the purposes of explanation, numerous specific details are set forth in order to provide a thorough understanding of the various aspects of the invention. It will be understood, however, by those skilled in the relevant arts, that the present invention may be practiced without these specific details. In other instances, known structures and devices are shown or discussed more generally in order to avoid obscuring the invention. In many cases, a description of the operation is sufficient to enable one to implement the various forms of the invention, particularly when the operation is to be implemented in software. It should be noted that there are many different and alternative configurations, devices and technologies to which the disclosed inventions may be applied. The full scope of the inventions is not limited to the examples that are described below.

In one application, a plurality of playing cards are provided, each of which are identical in material, construction and thickness and in the shape of a square including four equal sides and four right angle corners in the proposed size of 3.25" by 3.25". The cards may be fabricated from laminated paper, plastic or other suitable material from which playing cards are conventionally made. The rear faces of the cards, or backs, contain identical markings being the proposed trademark logo graphic representing the market name of the preferred embodiment of the invention. The cards' front faces have a white background upon which is imprinted visible indicia in the forms of either a single numerical digit, the letter W representing a wild card value, or both. The cards' indicia may be printed with colored ink to facilitate distinguishing the indicia at a glance during play.

The indicium is imprinted at the center position of each of the four card edges and is oriented to be visually proper to the edge so as to be readable from an edge-facing position. This orientation means that when any card is held up and viewed at forward and face level, the indicium at the 'bottom' side FIG. 1, 16 reads in a normal vertical orientation. Moving clockwise, the indicium at the 'left' side 16*a* will be oriented at a 90° right hand rotation, the indicium at the 'top' side 16*b* will be oriented upside down and the indicium at the 'right' side 16*c* will be oriented at a 90° left hand rotation. This will remain consistent regardless of how the card is rotated and is central to facilitating card play in any one of the four placement orientations.

The playing cards relate to one another in a novel way, such relationship allowing a series of game plays which enable the players to accumulate point scores based on the matching relationship between adjoining playing cards on the playing surface. See FIGS. 11 & 12.

Referring now in general to the invention, in FIGS. 1-13 there is shown a series of drawings that depict the eight card series sets, the division of playing areas, two definitive examples of play scoring and a common hand view.

Referring now to the invention in more detail, in FIG. 1 there is shown a card 10 representative of a subset of the card deck referred to as 'simple doubles'. This card sequence set contains cards imprinted with two numbers from 0 thru 9 on each card replicated in opposite card edge positions 12, 14 and identified as follows: nine cards bearing number sets 0s/1s>0s/9s; eight cards bearing number sets 1s/2s>1s/9s; seven cards bearing number sets 2s/3s>2s/9s which includes 2s/4s shown as card 10; six cards bearing number sets 3s/4s>3s/9s; five cards bearing number sets 4s/5s>4s/9s; four cards bearing number sets 5s/6s>5s/9s; three cards bearing number sets 6s/7s>6s/9s; two cards bearing number sets 7s/8s and 7s/9s; and one card bearing number set 8s/9s.

In more detail, still referring to FIG. 1, the duplicated digits 12, 14 are each facing their outer adjacent edges 16, 16*a*, 16*b*, 16*c* thereby being readable as edge-facing regardless of orientation. This facilitates the matching appearing as a mirrored image when adjoined edge to edge during play. Aside from the wild cards, all playing cards have this format.

Figure 2:
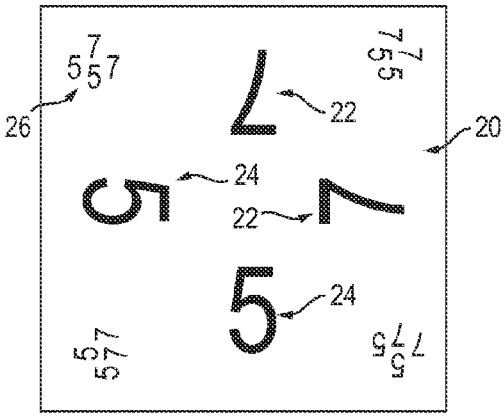
FIG. 2 depicts a top view of a representative card of a subset of the card deck of the present invention referred to as 'corner doubles'.

Referring now to the invention in more detail, in FIG. 2 there is shown a card 20 representative of a subset of the card deck referred to as 'corner doubles'. This card sequence set contains cards imprinted with two numbers from 0 thru 9 on each card replicated in adjacent card edge positions 22, 24 and identified as follows: nine cards bearing number sets 0s/1s>0s/9s; eight cards bearing number sets 1s/2s>1s/9s; seven cards bearing number sets 2s/3s>2s/9s; six cards bearing number sets 3s/4s>3s/9s; five cards bearing number sets 4s/5s>4s/9s; four cards bearing number sets 5s/6s>5s/9s, which includes 5s/7s shown as card 20; three cards bearing number sets 6s/7s>6s/9s; two cards bearing number sets 7s/8s and 7s/9s; and one card bearing number set 8s/9s.

In more detail, still referring to FIG. 2, each card has its current orientation represented in the upper left corner 26 no matter how the card is held or rotated to facilitate seeing each card's full face indicia when held in a normal fanned fashion. See FIG. 13.

Figure 3:
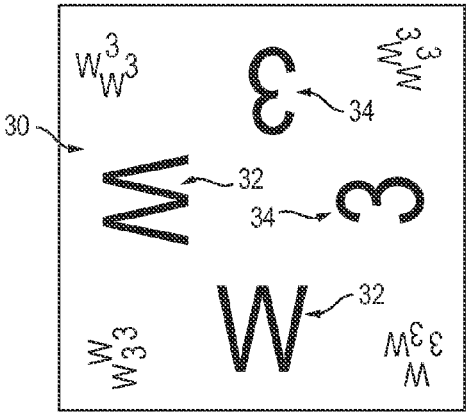
FIG. 3 depicts a top view of a representative card of a subset of the card deck of the present invention referred to as 'wild doubles'.

Referring now to the invention in more detail, in FIG. 3, there is shown a card 30 representative of a subset of the card deck referred to as 'wild doubles'. This card sequence set contains cards imprinted with one number from 1 thru 9, and a 'W' to represent wild, on each card and replicated in adjacent card edge positions 32, 34 and identified as nine cards bearing number sets Ws/1s>Ws/9s, which includes Ws/3s shown as card 30.

Figure 4:
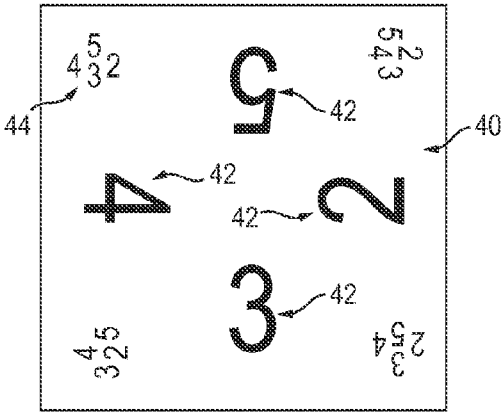
FIG. 4 depicts a top view of a representative card of a subset of the card deck of the present invention referred to as a 'natural sequence'.

Referring now to the invention in more detail, in FIG. 4, there is shown a card 40 representative of a subset of the card deck referred to as a 'natural sequence'. This card sequence set contains cards imprinted with four separate numbers in sequence with one number on each card edge position 42 and identified as seven cards bearing number sets 0/1/2/3; 1/2/3/4; 2/3/4/5 shown as card 40; 3/4/5/6; 4/5/6/7; 5/6/7/8; and 6/7/8/9.

In more detail, still referring to FIG. 4, the current card's orientation is represented in the upper left corner 44 to facilitate seeing the card's full face indicia when held in a normal fanned fashion. See FIG. 13.

Figure 5:
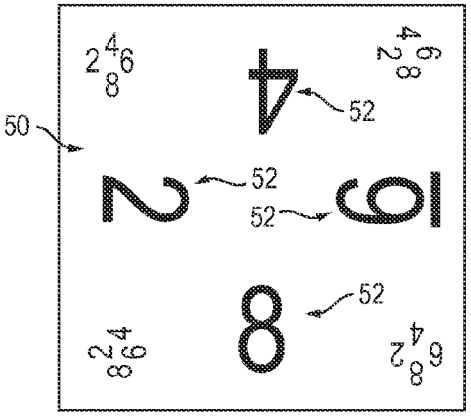
FIG. 5 depicts a top view of a representative card of a subset of the card deck of the present invention referred to as an 'even sequence'.

Referring now to the invention in more detail, in FIG. 5, there is shown a card 50 representative of a subset of the card deck referred to as an 'even sequence'. This card sequence set contains cards imprinted with four separate even numbers in sequence with one number on each card edge position 52 and identified as five cards bearing number sets 0/2/4/6; 0/2/4/8; 0/2/6/8; 0/4/6/8; and 2/4/6/8 shown as card 50.

Figure 6:
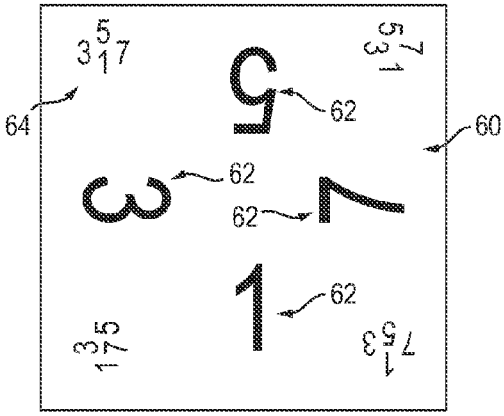
FIG. 6 depicts a top view of a representative card of a subset of the card deck of the present invention referred to as an 'odd sequence'.

Referring now to the invention in more detail, in FIG. 6, there is shown a card 60 representative of a subset of the card deck referred to as an 'odd sequence'. This card sequence set contains cards imprinted with four separate odd numbers in sequence with one number on each card edge position 62 and identified as five cards bearing number sets 1/3/5/7 shown as card 60; 1/3/5/9; 1/3/7/9; 1/5/7/9; and 3/5/7/9.

In more detail, still referring to FIG. 6, the card's 60 orientation is represented in the upper left corner 64 to facilitate seeing the card's full face indicia when held in a normal fanned fashion. See FIG. 13.

Figure 7:
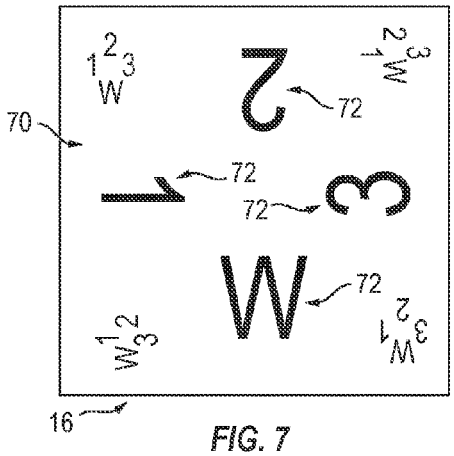
FIG. 7 depicts a top view of a representative card of a subset of the card deck of the present invention referred to as a 'wild sequence'.

Referring now to the invention in more detail, in FIG. 7, there is shown a card 70 representative of a subset of the card deck referred to as a 'wild sequence'. This card sequence set contains cards imprinted with a W to represent wild and three numbers in sequence with one indicia on each card edge position 72 and identified as nine cards bearing number sets W/0/1/2; W/1/2/3 shown as card 70; W/2/3/4; W/3/4/5; W/4/5/6; W/5/6/7; W/6/7/8; W/7/8/9; and W/8/9/0.

Figure 8:
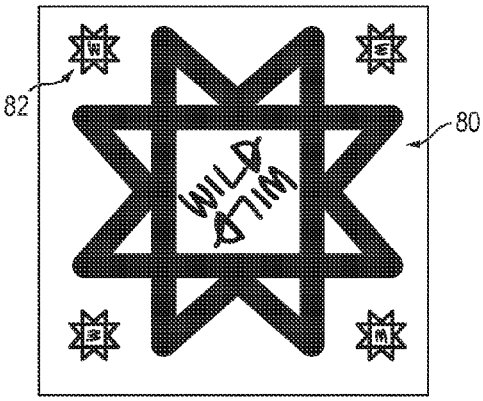
FIG. 8 depicts a top view of a representative card of a subset of the card deck of the present invention referred to as 'master wilds'.

Referring now to the invention in more detail, in FIG. 8, there is shown a card 80 representative of a subset of the card deck referred to as a 'master wild'. This card set contains cards imprinted with a 4-sided W-based graphic to represent wild on each card edge position and identified as four cards bearing this symbol.

In more detail, still referring to FIG. 8, the card's universal Wild value is represented 82 in the same manner as an indicia bearing playing card regardless of orientation.

Figure 9:
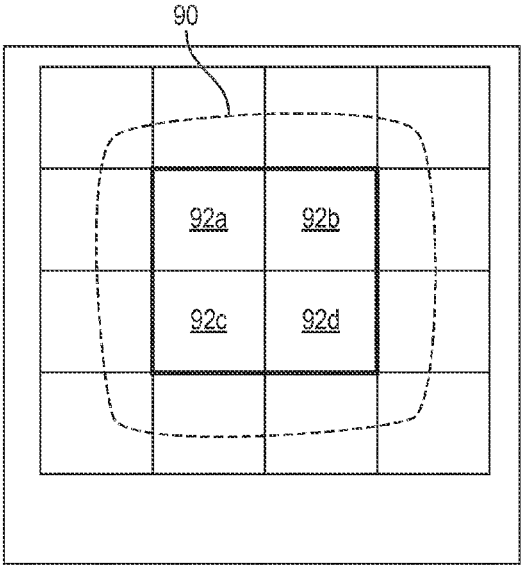
FIG. 9 depicts a top view of the 16-card grid playing area called the 'board' with initial House setup.
Figure 10:
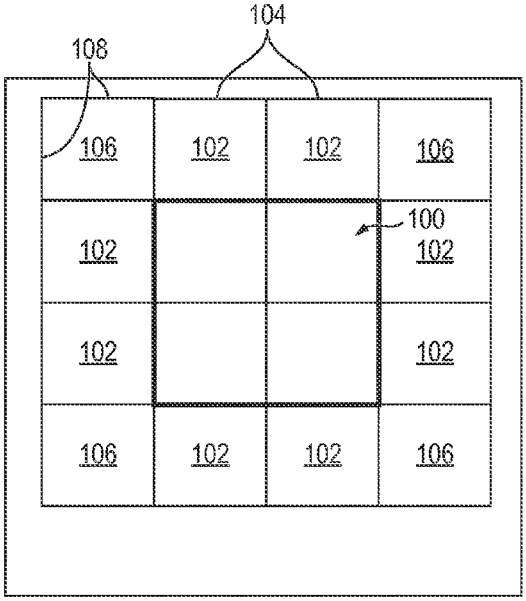
FIG. 10 depicts a top view of the two distinct playing sections of the board.

Referring now to the invention in more detail, in FIG. 9, there is shown the playing area of the preferred embodiment of the present invention referred to as the 'board'. The board is a 16 card playing area comprised of a square 4×4 card grid that creates a 4-card square center 92*a-d* surrounded by twelve more cards 90. The center four cards are referred to as the House field 92*a-d* and the twelve surrounding cards are referred to as the Ring field 90. According to the method of playing in the preferred embodiment, the dealer uses only the House field 92*a-d* and the other players use only the Ring field 90. As play progresses, each player will be the dealer once in a game so every player has played as the House playing against the Ring.

Referring now to the invention in more detail, in FIG. 10, there is shown again the board, but more specifically where matching dynamics are defined. The current dealer playing the House field 100 is confined to the four positions of the board center so each position will have all four card sides on every play subject to scoring based on what matches and what does not. The chosen card, its rotated orientation and its position placement, all play in integral part in scoring potential and all four sides must be considered. In contrast, the other players are confined to the twelve outer Ring field 90 positions identified in FIG. 9. Eight Ring positions, of which four are illustrated by components 102, will have three out of four card sides on every play subject to scoring based on what matches and what does not. The fourth side does not adjoin another card 104 and cannot be scored. This is referred to as a 'dead side'. The last four Ring positions, of which two are illustrated by component 106, are at the four corners and will have only two out of four card sides on every play subject to scoring based on what matches and what does not. The third and forth sides do not adjoin another card 108 and cannot be scored, because they are 'dead sides'.

Figure 11:
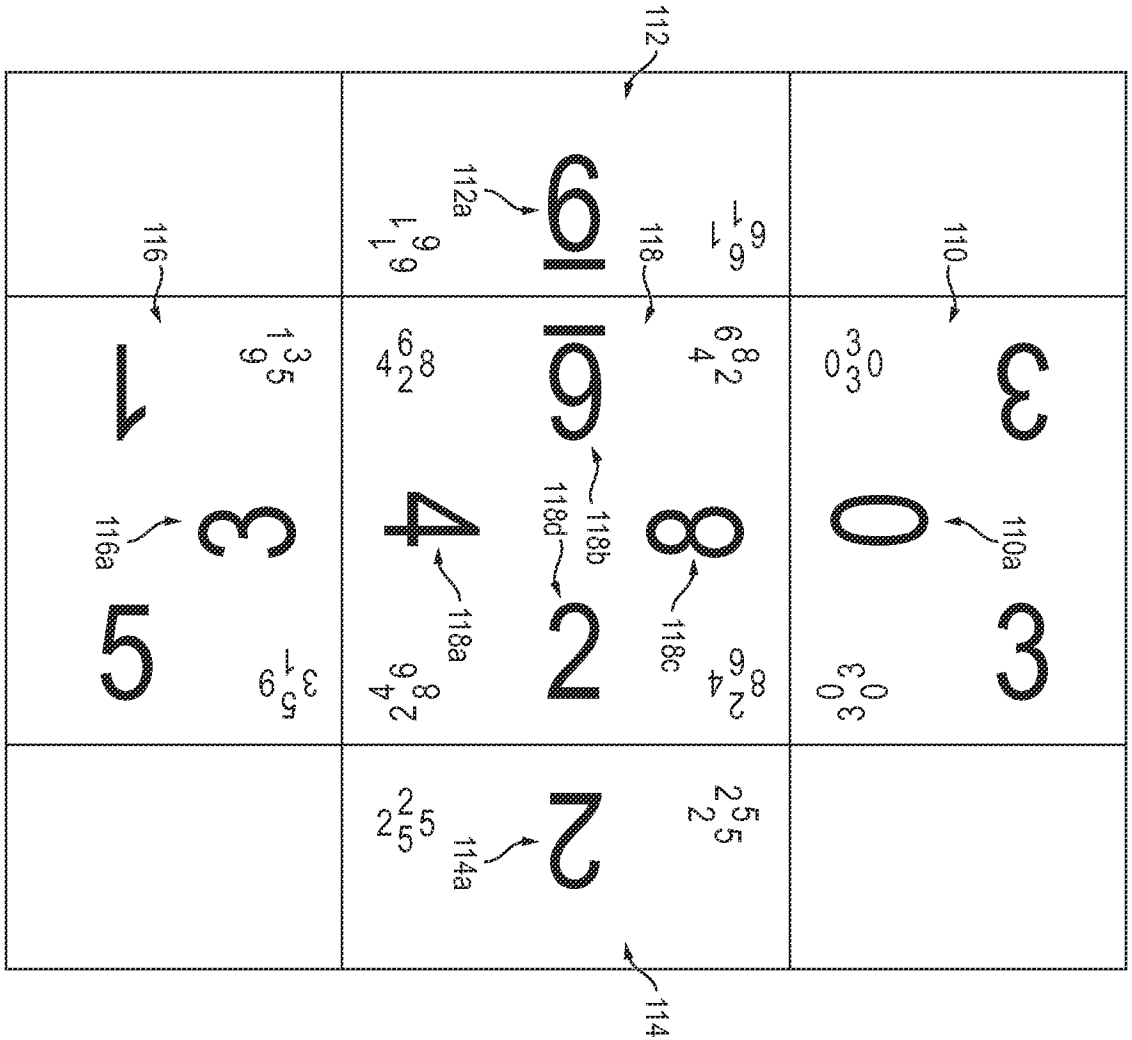
FIG. 11 depicts a top view of scoring a House field play against the Ring field.

Referring now to the invention in more detail, in FIG. 11, there is shown a card 118 played onto a position in the House field against four adjoining cards 110, 112, 114, 116. According to the scoring method of the preferred embodiment of the present invention, all numbers of the card played 118 that match with the numbers of adjoining cards 112, 114, noted as matched sets 118*b*/112*a* and 118*d*/114*a*, are summed and then doubled for the points sub-total. All numbers of the card played 118 that do not match with the numbers of adjoining cards 110, 116, noted as mismatched sets 118*c*/110*a* and 118*a*/116*a*, are all summed and then subtracted from the initial points for a recordable play score.

The specific scoring method for played card 118 is demonstrated here in FIG. 11 as follows:

Components 118*b*/112*a* is a 6/6 match, summed to 12;

Components 118*d*/114*a* is a 2/2 match, summed to 4;

All matches are summed to 16, then doubled to 32 initial points;

Components 118*c*/110*a* is a 8/0 mismatch, summed to 8;

Components 118*a*/116*a* is a 4/3 mismatch, summed to 7;

All mismatches are summed to 15 then subtracted from the 32 initial matching points; and The final recordable score is 17.

Figure 12:
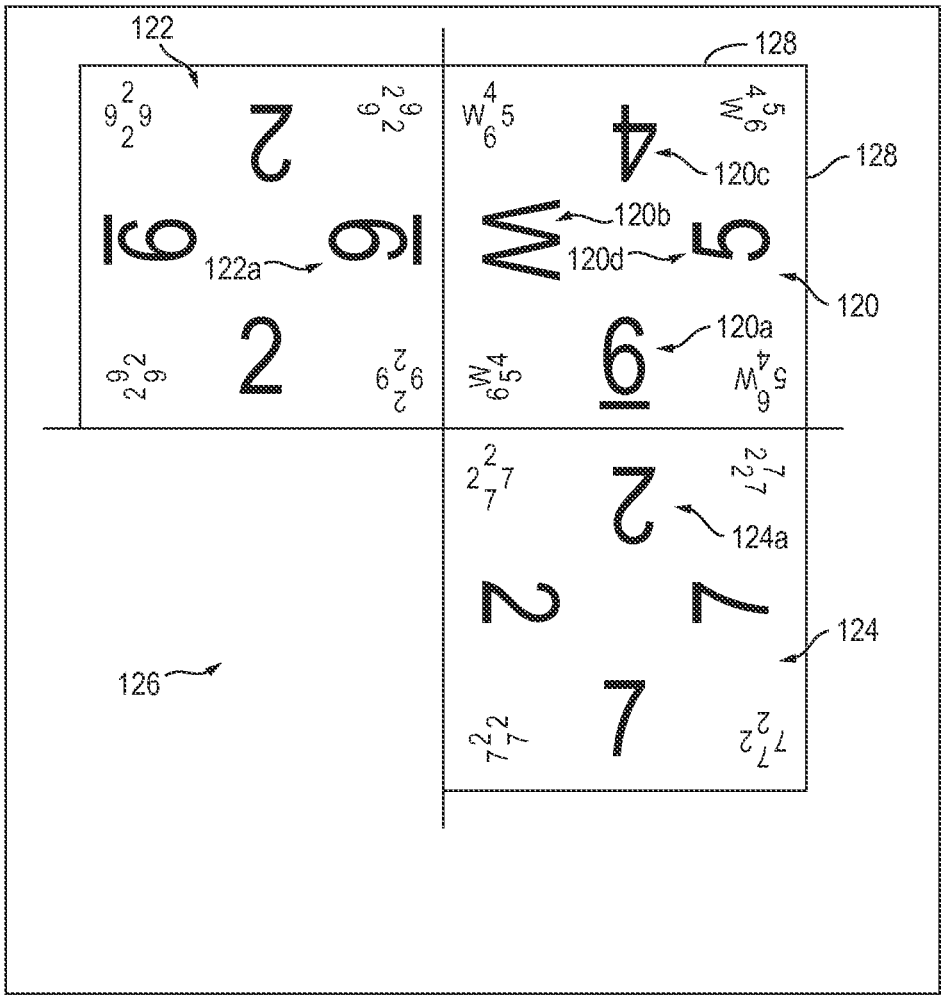
FIG. 12 depicts a top view of scoring a Ring field play at a corner position.

Referring now to the invention in more detail, in FIG. 12, there is shown a card 120 played onto a corner position in the Ring field against two adjoining cards 122, 124. According to the scoring method of the preferred embodiment of the present invention, the number of the card played 120 that matches with the adjoining card 122, noted as matched set 120*b*/122*a*, are summed and then doubled for the points sub-total. The number of the card played 120 that does not match with the number of adjoining card 124, noted as mismatched set 120*a*/124*a*, are summed and then subtracted from the initial points for a recordable play score. The third and forth sides do not adjoin another card 128 and cannot be scored, because they are 'dead sides'. Notice also that any card played at a Ring field corner 120 does not affect the House field 126 in any way because there are no adjoining sides.

The specific scoring method for played card 120 is demonstrated here in FIG. 12 as follows:

All wild indicia is valued as equal to the number it matches so 120*b*=122*a* as 9;

Components 120*b*/122*a* is a 9/9 match, summed to 18, then doubled to 36 initial points;

Components 120*a*/124*a* is a 6/2 mismatch, summed to 8;

The mismatches summed to 8 are then subtracted from the 36 initial matching points; and The final recordable score is 28.

Figure 13:
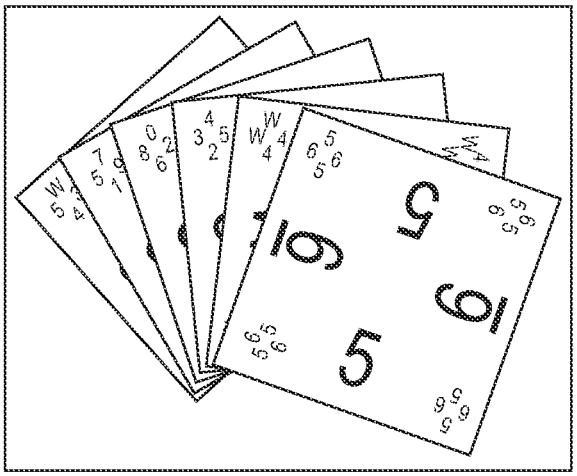
FIG. 13 depicts a top view of a common 6-card hand in a normal fanned fashion.

Referring now to the invention in more detail, in FIG. 13, there is shown a common 6-card hand held in normal fanned fashion. Note that the number group printed on all cards' upper left corner makes the cards' face layout visible at all times. During normal play, a player will repeatedly pull and rotate various cards to visually pre-assess their point potential for different placement positions on the board.

Referring now to the Method of Playing the preferred embodiment of the present invention: The players will first agree on one of the several game variations to be played. For the purposes of this disclosure, we will use the game embodiment this inventor refers to as 'four player/half-deck'. The game of the preferred embodiment is played in as many hands as there are players so each player has one turn as the dealer and playing the House field. There are 129 playing cards in the deck, including the four wild cards. A dealer is chosen by randomly selecting a card from the deck and comparing the arithmetic sum totals. Wild indicia are valued as ten for this purpose. The player with the highest card total is the first dealer.

The cards are shuffled and dealt face down in a normal clockwise cycle to all players. The players each receive the first six cards, which they will pick up and use as their play hand, FIG. 13. The dealer continues to deal ten more cards per player that are to be stacked face down in front of each player and is considered the player's individual reserve deck from which a replacement card will be drawn after each play is made to the board so each player maintains a full 6-card hand. Last, the dealer deals the House layout face up to the board center according to FIG. 9; beginning at upper left 92*a*, then upper right 92*b*, lower left 92*c* and lower right 92*d*. The four cards are dealt in this sequence as they are flipped straight off the deck top without rotation. This rule insures that no effort is made to incidentally advantage either playing field. Upon completion of the deal, including having set up the initial House field, the remainder of the deck is set aside as the pool which may be drawn from in accordance with the rules. Play begins to the left of the dealer and moves clockwise. A turn comprises laying down a playing card so that at least one edge of each newly played card adjoins an edge of a previously played card so that the numbered sides of the newly played card match the numbers at the adjoining edges of previously played cards. The first course of action is to establish the Ring field FIG. 9, 90 with consecutive player turns playing to any open Ring field position until the Ring is completed. The Ring field's twelve positions may be played to in random order, however, all twelve Ring field positions 90 need to be filled to first complete the required Ring. Meanwhile, the dealer plays only atop the four existing cards restricted to the board center 92*a-d* as the House field and will for the entire hand. After the Ring field is completed, the Ring field players may begin to play atop any card in the Ring field at will, but cannot play atop the cards in the House field, which remains the domain of the dealer. While scoring is the prime objective, the play mechanics between the House 92*a-d* and the Ring 90 fields are such that calculating the scoring variants often becomes secondary to competitive strategizing. Although the arithmetic landscape changes on various parts of the board with each play, it is possible to use a disadvantageous play to either set up for a large payoff play if the opportunity still exists upon the player's next turn, or to manipulate the board's arithmetic landscape as a way to mitigate an incidental field advantage inherent in the current board.

Scoring is consistently in accordance with the manners illustrated in the detailed descriptions of FIGS. 11 & 12 above. The House field 100 scoring represented by FIG. 11, 118 is common to all four House field positions. The Ring field 90 scoring for positions that are not on a corner will always have three scoring sides as representatively indicated in FIG. 10, 102. Corner positions will always have only two scoring sides as illustrated in FIG. 12, 120.

During the course of play, the rules provide for two adaptive play variants, the Pass or the Pull, which a player may choose if at the time of the player's turn it is deemed that the hand held cards offer limited options. In the Pass, the player declares a Pass and in lieu of the play, chooses one hand held card to surrender to the dealer to be set aside and be out of play for the remainder of the hand. The player then takes as the score for that play a negative score equal to the summed face value of the surrendered card. In the Pull, the player declares a Pull and draws a single card from the undealt card deck remainder called the pool. The player now has this extra card for play consideration, but still remains obligated to play a card onto the board. This option leaves the player with one extra card in hand, the summed face total of which will count against the player at the end of the hand. The Pass or Pull options may be exercised severally or jointly no more than three times total per hand.

Play continues clockwise until all reserve decks are exhausted and all remaining hand cards have been played out with the dealer playing the last card. After adjusting the running hand score for any leftover cards, the player with the highest score wins the hand. After each player has played the dealer/House position once, the game ends when all have gone out. The player with the highest aggregate score of all hands wins.

Ancillary Embodiments and Forms

Timed Formats:

An embodiment of the present invention further includes a time limit for play by each player. During each play by each player, in accordance with this embodiment, that player has a limited amount of time to play, such as one minute.

Competition Formats:

An embodiment of the present invention further includes competition formats with graded skill level advancement toward a champion skill level contest.

Computerized and Web-based Applications:

While the invention is presently illustrated in the form of tangible and visible cards, the mathematical principles and concepts can be easily incorporated into a computer program and mobile applications designed for interactive engagement with other players on the Internet.

Physical Board:

An embodiment of the present invention further includes a specialized playing surface for holding the cards in fixed placed positions in which the surface includes a grid of card sized indentations or a raised ridged grid into which the cards are placed when played. In yet another embodiment, the playing surface includes only drawn or otherwise optically indicated placement positions for cards.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention.

Play Variations

Mahta Mahti is a variable-play game from short-term 'Rounds' to 'Full-Deck' depending on the players' interests. Play variations are mixed to create Competition level formats and may be mixed in ways that will help my team make the finals. After that it's up to you to lose.

Rounds—3-8 Players. A format that deals 8 cards to each player's hand and simply foregoes the Reserve Deck to shorten the game time so all players will have an opportunity to play the House field (dealer). The game comprises one House round per player and the winner is the player with the highest cumulative score after the game.

Half Deck—3-6 Players. A format that deals 12-21 cards to each player—6 for the hand and 6-15 for the player's Reserve Deck depending on the number of players:

1. A 3-player table has a 15 card reserve;
2. A 4-player table has a 12 card reserve;
3. A 5-player table has a 9 card reserve; and
4. A 6-player table has a 6 card reserve.

In a Half Deck format, the House player is chosen at random by dealing the first six cards and totaling their face values. The winner is the player with the highest score at game end.

Full Deck—6 or more Players—A format that deals 6 cards to each player's hand and the rest of the cards to the players' reserve decks except for the Pool. The Pool will retain one card for each player plus any remainder cards that cannot be otherwise evenly distributed. If the Pool is exhausted during play, it remains empty and the Pull option is closed for the rest of the game. Full Deck is a single round game where the House is randomly chosen and the winner is the player with the highest score at game end. This is a longer game format, but it also ensures that almost every card is played including likely all wild cards and the four Mahta Mahti Cards (master wild cards).

Open House—A Rounds, Half Deck or Full Deck format modification where the full 16 card playing board is dealt, the field boundaries are removed and the full board is open to all players. Dealer may be randomly chosen or cycled if playing the Rounds format. Cards are dealt from the deck top with the same orientation in 4 card rows left to right and top to bottom. Play and scoring is normal.

Double Play Open House—A Rounds, Half Deck or Full Deck format modification where the full 16 card playing board is dealt, the field boundaries are removed and the full board is open to all players. Cards are dealt from the deck top with the same orientation in 4 card rows left to right and top to bottom. Double Play Open House adds a strategy twist where each play comprises two phases. In phase one, the player chooses a playable card from the Ring field and plays it into the House field, then calculates phase one. In phase two, the player must replace the moved card with a card from his/her Play Hand and calculate phase two. The Score is the sum of the two play phases. This format provides for high scoring and extra strategy where one phase may take a loss to make way for a larger overall play score. It is the longest format when played with Full Deck.

Duplex—(Double House)—A Half Deck or Full Deck format modification where a full 25 card playing board is dealt from the deck top with the same orientation in five 5-card rows left to right and top to bottom. Duplex adds a 'second House' by accessing both the board center and the inner ring as the Ring Players use both outer rings. The House and Ring players 'share' the middle ring. The House plays on 16 cards and the Ring plays on 21 cards. This variation may be used as the Final in competition play. This format provides for high scoring and extra strategy where players can directly affect each other's fields.

2 Player Versions: (Mix and share deck shuffling—it's easier that way)

Open House—Per instructions, deal both players 6 cards each as a play hand and 6 more as the reserve stack. Then deal 16 cards face up onto the table as 4 rows of 4 cards per row until there is a playing area 16 cards square. All cards are to be dealt in left to right sequence as they come off the deck top and without rotating them. "Open House" means that there is no House field distinction for the dealer and therefore is not "closed" to the other player. All 16 positions are fair game. Because all 16 cards are dealt into place at the beginning, all played cards will be placed atop existing cards according to scoring opportunities (the play area never exceeds 16 cards square). Play begins with the other player and alternates normally until all 12 dealt cards for the hand (and reserve stack) are exhausted. All other rules apply including Pass and Pull. The high score wins. This version is social in nature with all play consideration being simply about card choice, orientation and board placement for maximum scoring. Pogo—In this sub category of 'Open House', dealing of the hands and board setup are the same. This derivative differs in play pattern where the two players alternately bounce back and forth (pogo) between the two playing fields; House (center 4 cards) and Ring (outer 12 cards). Play sequence begins with player 2 playing one card in the House, followed by player 1 (dealer) playing one card on the Ring. Because Player 2 just played in the House, his/her next turn goes to the Ring. Because Player 2's first turn was on the Ring, his/her next turn is in the House. Consecutive plays have the players alternating between the fields. This sequence has the effect of two plays in one field followed by two plays in the other field, and by alternating players. Below is what the Pogo sequence looks like:

| Player 1 (dealer) | Player 2 |
|---|---|
| Deals | plays House (first play) |
| Plays ring | plays Ring |

-continued

| Player 1 (dealer) | Player 2 |
|---|---|
| Plays House | House |
| Ring | Ring |
| House | House (etc) |

Play alternates until all 12 dealt cards for the hand (and reserve stack) are exhausted. All other rules apply including Pass and Pull. The high score wins.

This version is particularly fun because it introduces hand management strategy where one play in one field can be purposely calculated to set up a better scoring play on the next field.

I claim:

1. A method of playing a game, comprising:

using a square grid playing board, wherein the square grid playing board comprises:

a house field comprising at least one center square; and a ring field comprising at least eight outer squares surrounding the house field;

using a deck of playing cards, wherein the deck of playing cards comprises:

a playing card displaying a master wild; and playing the game by performing the following acts:

(1) shuffling the deck of playing cards and dealing, by a dealer, an equal number of playing cards, wherein each of the equal number of playing cards comprises a front face having a symbol imprinted at a center position of each edge, to the dealer and at least one player while retaining a group reserve deck of playing cards from among the deck of playing cards;

(2) dealing at least one playing card from the group reserve deck of playing cards to the at least one center square of the house field to ensure that the house field does not include empty squares;

(3) the at least one player making a move, comprising performing one of the following:

(a) moving a play, further comprising choosing one playing card from the equal number of playing cards dealt to the at least one player and placing the playing card face-up in one of the open ring field outer squares so that at least one edge of each newly played playing card adjoins an edge of a previously played playing card, and the symbols of the newly played playing card align with the symbols at the adjoining edges of the previously played playing cards;

(b) moving a pass, further comprising choosing one playing card from the equal number of playing cards dealt to the at least one player and surrendering the playing card to the dealer as dead for the remainder of the hand, summing the symbols of the surrendered playing card, and recording a pass score; and (c) moving a pull, further comprising choosing one playing card from the group reserve deck, adding the playing card to the equal number of playing cards dealt to the at least one player, making the play move, summing the symbols of the pulled playing card, and recording a pull score;

(4) calculating, for each adjoining edge of a newly played playing card, one of the following:

(a) a point sub-total for each play by summing a symbol of the newly played playing card that matches a symbol at the adjoining edge of the previously played playing card with the matched symbol on the board, then doubling the sum, wherein a value of a wild is equal to the symbol of the adjoining edges of the previously played playing card after a play move; and (b) a value for each play by summing a symbol of the newly played playing card that mismatches a symbol at the adjoining edge of the previously played playing card with the mismatched symbol, wherein a value of a wild is equal to the symbol of the adjoining edges of the previously played playing card after a play move;

(5) subtracting the value from the sub-total for a recordable score;

(6) recording the recordable score for each play;

(7) continuing the game with each successive player and dealer making a play only in empty ring field squares until the ring field squares are full, upon which the successive player and dealer are permitted to make a play atop any of the previously played playing cards;

(8) repeating steps (3) to (7) until all playing cards from the at least one player's and the dealer's equal number of playing cards are exhausted;

(9) adding respective recordable scores to determine respective hand scores;

(10) adding the respective pass and pull scores for a respective penalty score, and subtracting the respective penalty scores from the respective hand scores; and

(11) identifying a winner with a highest hand score.

2. The method according to claim 1, further comprising restricting the dealer's moves to the house field and restricting the at least one player's moves to the ring field, and repeating steps (1) to (10) after step (10) until each player has played the dealer during the hand, calculating an aggregate score of each player by adding the respective hand scores, identifying the winner with a highest aggregate score.

3. The method according to claim 1, further comprising dealing two equal sets of playing cards to both the dealer and the at least one player, wherein the two equal sets of playing cards comprise a set of playing cards for individual game play and a set of playing cards for individual reserve play, with each player taking a playing card from the individual game set after each play.

4. The method according to claim 1, wherein the deck of playing cards further comprises a playing card displaying simple doubles.

5. The method according to claim 1, wherein the deck of playing cards further comprises a playing card displaying corner doubles.

6. The method according to claim 1, wherein the deck of playing cards further comprises a playing card displaying wild doubles.

7. The method according to claim 1, wherein the deck of playing cards further comprises a playing card displaying natural sequences.

8. The method according to claim 1, wherein the deck of playing cards further comprises a playing card displaying even sequences.

9. The method according to claim 1, wherein the deck of playing cards further comprises a playing card displaying odd sequences.

10. The method according to claim 1, wherein the deck of playing cards further comprises a playing card displaying wild sequences.

11. The method according to claim 1, further comprising a time limit for each of the moves.

12. The method according to claim 1, further comprising an open house format, a pogo format, a double play format, or a duplex format.

13. The method according to claim 1, further comprising incorporating the game into a computer program designed for interactive engagement of players via internet.

14. A method of playing a game, comprising:

using a square grid playing board, wherein the square grid playing board comprises:

a house field comprising at least one center square; and a ring field comprising at least eight outer squares surrounding the house field;

using a deck of playing cards, wherein the deck of playing cards comprises:

a playing card displaying wild doubles; and playing the game by performing the following acts:

(1) shuffling the deck of playing cards and dealing, by a dealer, an equal number of playing cards, wherein each of the equal number of playing cards comprises a front face having a symbol imprinted at a center position of each edge, to the dealer and at least one player while retaining a group reserve deck of playing cards from among the deck of playing cards;

(2) dealing at least one playing card from the group reserve deck of playing cards to the at least one center square of the house field to ensure that the house field does not include empty squares;

(3) the at least one player making a move, comprising performing one of the following:

(a) moving a play, further comprising choosing one playing card from the equal number of playing cards dealt to the at least one player and placing the playing card face-up in one of the open ring field outer squares so that at least one edge of each newly played playing card adjoins an edge of a previously played playing card, and the symbols of the newly played playing card align with the symbols at the adjoining edges of the previously played playing cards;

(b) moving a pass, further comprising choosing one playing card from the equal number of playing cards dealt to the at least one player and surrendering the playing card to the dealer as dead for the remainder of the hand, summing the symbols of the surrendered playing card, and recording a pass score; and (c) moving a pull, further comprising choosing one playing card from the group reserve deck, adding the playing card to the equal number of playing cards dealt to the at least one player, making the play move, summing the symbols of the pulled playing card, and recording a pull score;

(4) calculating, for each adjoining edge of a newly played playing card, one of the following:

(a) a point sub-total for each play by summing a symbol of the newly played playing card that matches a symbol at the adjoining edge of the previously played playing card with the matched symbol on the board, then doubling the sum, wherein a value of a wild is equal to the symbol of the adjoining edges of the previously played playing card after a play move; and (b) a value for each play by summing a symbol of the newly played playing card that mismatches a symbol at the adjoining edge of the previously played playing card with the mismatched symbol, wherein a value of a wild is equal to the symbol of the adjoining edges of the previously played playing card after a play move;

(5) subtracting the value from the sub-total for a recordable score;

(6) recording the recordable score for each play;

(7) continuing the game with each successive player and dealer making a play only in empty ring field squares until the ring field squares are full, upon which the successive player and dealer are permitted to make a play atop any of the previously played playing cards;

(8) repeating steps (3) to (7) until all playing cards from the at least one player's and the dealer's equal number of playing cards are exhausted;

(9) adding respective recordable scores to determine respective hand scores;

(10) adding the respective pass and pull scores for a respective penalty score, and subtracting the respective penalty scores from the respective hand scores; and

(11) identifying a winner with a highest hand score.

15. The method according to claim 14, wherein the deck of playing cards further comprises a playing card displaying wild sequences.

16. The method according to claim 14, wherein the deck of playing cards further comprises a playing card displaying a master wild.

17. A method of playing a game, comprising:

using a square grid playing board, wherein the square grid playing board comprises:

a house field comprising at least one center square; and a ring field comprising at least eight outer squares surrounding the house field;

using a deck of playing cards, wherein the deck of playing cards comprises:

a playing card displaying wild sequences; and playing the game by performing the following acts:

(1) shuffling the deck of playing cards and dealing, by a dealer, an equal number of playing cards, wherein each of the equal number of playing cards comprises a front face having a symbol imprinted at a center position of each edge, to the dealer and at least one player while retaining a group reserve deck of playing cards from among the deck of playing cards;

(2) dealing at least one playing card from the group reserve deck of playing cards to the at least one center square of the house field to ensure that the house field does not include empty squares;

(3) the at least one player making a move, comprising performing one of the following:

(a) moving a play, further comprising choosing one playing card from the equal number of playing cards dealt to the at least one player and placing the playing card face-up in one of the open ring field outer squares so that at least one edge of each newly played playing card adjoins an edge of a previously played playing card, and the symbols of the newly played playing card align with the symbols at the adjoining edges of the previously played playing cards;

(b) moving a pass, further comprising choosing one playing card from the equal number of playing cards dealt to the at least one player and surrendering the playing card to the dealer as dead for the remainder of the hand, summing the symbols of the surrendered playing card, and recording a pass score; and (c) moving a pull, further comprising choosing one playing card from the group reserve deck, adding the playing card to the equal number of playing cards dealt to the at least one player, making the play move, summing the symbols of the pulled playing card, and recording a pull score;

(4) calculating, for each adjoining edge of a newly played playing card, one of the following:

(a) a point sub-total for each play by summing a symbol of the newly played playing card that matches a symbol at the adjoining edge of the previously played playing card with the matched symbol on the board, then doubling the sum, wherein a value of a wild is equal to the symbol of the adjoining edges of the previously played playing card after a play move; and (b) a value for each play by summing a symbol of the newly played playing card that mismatches a symbol at the adjoining edge of the previously played playing card with the mismatched symbol, wherein a value of a wild is equal to the symbol of the adjoining edges of the previously played playing card after a play move;

(5) subtracting the value from the sub-total for a recordable score;

(6) recording the recordable score for each play;

(7) continuing the game with each successive player and dealer making a play only in empty ring field squares until the ring field squares are full, upon which the successive player and dealer are permitted to make a play atop any of the previously played playing cards;

(8) repeating steps (3) to (7) until all playing cards from the at least one player's and the dealer's equal number of playing cards are exhausted;

(9) adding respective recordable scores to determine respective hand scores;

(10) adding the respective pass and pull scores for a respective penalty score, and subtracting the respective penalty scores from the respective hand scores; and

(11) identifying a winner with a highest hand score.

18. The method according to claim 17, wherein the deck of playing cards further comprises a playing card displaying a master wild.

19. The method according to claim 17, wherein the deck of playing cards further comprises a playing card displaying wild doubles.

20. The method according to claim 17, further comprising incorporating the game into a computer program designed for interactive engagement of players via internet.

* * * * *